US009345292B2

(12) United States Patent
Geiser et al.

(10) Patent No.: US 9,345,292 B2
(45) Date of Patent: May 24, 2016

(54) SYSTEM OF ASSEMBLING AT LEAST THREE PARTS

(71) Applicant: Comadur S.A., Le Locle (CH)

(72) Inventors: Alain Geiser, Murten (CH); Sylvain Boucard, Villers-le-Lac (FR)

(73) Assignee: Comadur S.A., Le Locle (CH)

( * ) Notice: Subject to any disclaimer, the term of this patent is extended or adjusted under 35 U.S.C. 154(b) by 136 days.

(21) Appl. No.: 14/257,121

(22) Filed: Apr. 21, 2014

(65) Prior Publication Data

US 2014/0338398 A1 Nov. 20, 2014

(30) Foreign Application Priority Data

May 17, 2013 (EP) ..... 13168273

(51) Int. Cl.
*A44C 5/08* (2006.01)
*A44C 5/10* (2006.01)

(52) U.S. Cl.
CPC ..... *A44C 5/107* (2013.01); *Y10T 403/32951* (2015.01)

(58) Field of Classification Search
None
See application file for complete search history.

(56) References Cited

U.S. PATENT DOCUMENTS 6,564,540 B2 * 5/2003 Greguitch ..... A44C 5/107 59/78
6,622,469 B2 * 9/2003 Gunster ..... A44C 5/107 59/80
7,146,793 B1 * 12/2006 Hyun ..... A44C 5/107 59/80
7,594,385 B2 * 9/2009 Kriknoff ..... A44C 5/105 59/31
2012/0198885 A1 8/2012 Bolzt et al.

FOREIGN PATENT DOCUMENTS

| | | |
|---|---|---|
| EP | 0 842 731 A1 | 5/1998 |
| EP | 1 967 087 A1 | 9/2008 |
| EP | 2 484 246 A1 | 8/2012 |
| JP | 2003-180414 | 7/2003 |

OTHER PUBLICATIONS

European Search Report issued Sep. 25, 2013, in Patent Application No. EP 13 16 8273, filed May 17, 2013 (with English-language translation).

* cited by examiner

*Primary Examiner* — Jack W Lavinder
(74) *Attorney, Agent, or Firm* — Oblon, McClelland, Maier & Neustadt, L.L.P.

(57) ABSTRACT

The invention relates to an assembly system including first and second parts each including a blind recess and at least one third part including a through hole. According to the invention, the assembly system further includes a permanent securing device including a pin mounted in the through hole of the at least one third part, the pin including, at a first end, a first means of locking one of the first and second parts in its blind recess, and a socket whose external wall includes a second means of locking the other of the first and second parts in its blind recess, and whose internal wall is welded to the second end of the pin in order to join the first, second and at least one third parts to each other with no plastic deformation of the first and second parts.

11 Claims, 3 Drawing Sheets

SYSTEM OF ASSEMBLING AT LEAST THREE PARTS

This application claims priority from European Patent Application No. 13168273.4 filed May 17, 2013, the entire disclosure of which is incorporated herein by reference.

FIELD OF THE INVENTION

The invention relates to a system of assembling at least three parts and, more specifically, wherein a portion of the parts cannot be secured by plastic deformation.

BACKGROUND OF THE INVENTION

It is known to drive pins into a blind drilled hole or bore to form integral parts, possibly also hinged to each other, such as for example, a watch bracelet or wristband. However, when a portion of the parts is formed of a hard material, such as diamond or ceramic, driving in is no longer possible without damaging the parts which cannot stand plastic deformation.

It is also known to secure pins by adhesive bonding in a blind drilled hole or bore to form integral parts. However, when a portion of the parts is formed of a hard material such as diamond or ceramic, adhesive bonding is also unsatisfactory since the securing cannot be guaranteed over time.

SUMMARY OF THE INVENTION

It is an object of the present invention to overcome all or part of the aforecited drawbacks by proposing an assembly system with no plastic deformation of parts made of hard materials and an assortment, such as a bracelet or wristband, a decorative article or a jewelry item including several integral and possibly hinged assembly systems.

The invention therefore relates to an assembly system including first and second parts each including a blind recess and at least a third part including a through hole, characterized in that the assembly system further includes a permanent securing device including a pin mounted in the through hole of the at least one third part, the pin including, at a first end, a first means of locking one of the first and second parts in its blind recess, and a socket whose external wall includes a second means of locking the other of the first and second parts in its blind recess, and whose internal wall is welded to the second end of the pin in order to secure the first and second and at least one third parts to each other with no plastic deformation of the first and second parts.

It is thus clear that it is possible to make one part of the assembly system invisible without using any driving in operation, i.e. without plastic deformation, or any adhesive bonding, i.e. providing a better guarantee of the mechanical strength of the assembly system even when it is subjected to repeated shocks and/or cleaning in ultrasonic baths.

In accordance with other advantageous features of the invention:

- the through hole has a cross-section of matching non-circular shape to that of the pin, to prevent any relative pivoting of the first, second and at least one third parts;
- the through hole has a cross-section of matching circular shape to that of the pin to allow the pivoting of the at least one third part relative to the first and second parts;
- the first locking means and/or second locking means are formed by an internal-external thread or bayonet type device;
- the at least one third part includes several parts forming the through hole;

- at least one portion of the first and second parts is formed with enamel and/or stone and/or ceramic.

Further, the invention relates to an assortment characterized in that it includes at least two assembly systems according to any of the preceding variants, which are connected to each other by a non-permanent securing device, the non-permanent securing device including a pin removably mounted in a second through hole in one of the at least one third part of one of the at least two assembly systems and in second recesses in each of the first and second parts of the other of the at least two assembly systems.

It is thus clear that it is possible to manufacture an assortment from several assembly systems which are secured and/or hinged to each other, each assembly system forming an assembly of at least three parts which are secured and/or hinged to each other.

In accordance with other advantageous features of the invention:

- at least one of the second recesses in each of the first and second parts of the other of the at least two assembly systems are blind in order to render the assortment substantially inseparable;
- at least one of the second recesses of each of the first and second parts of the other of the at least two assembly systems are through recesses in order to render the assortment detachable;
- the assortment includes at least five assembly systems connected to form a bracelet or wristband, a decorative article or a jewelry item.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

The terms "hard materials" according to the invention refer to materials whose hardness is substantially equal to or greater than 600 HV and which accept little or no plastic deformation under stress before breaking. These hard materials may be used, in particular, for making all or part of wristbands or bracelets, decorative articles or jewelry items. By way of non-limiting example, the following may be cited as hard materials: enamels, precious or non-precious stones, such as ruby, sapphire or quartz, ceramics such as a metallic or non-metallic oxide, carbide or nitride or hard metals.

Figure 1:
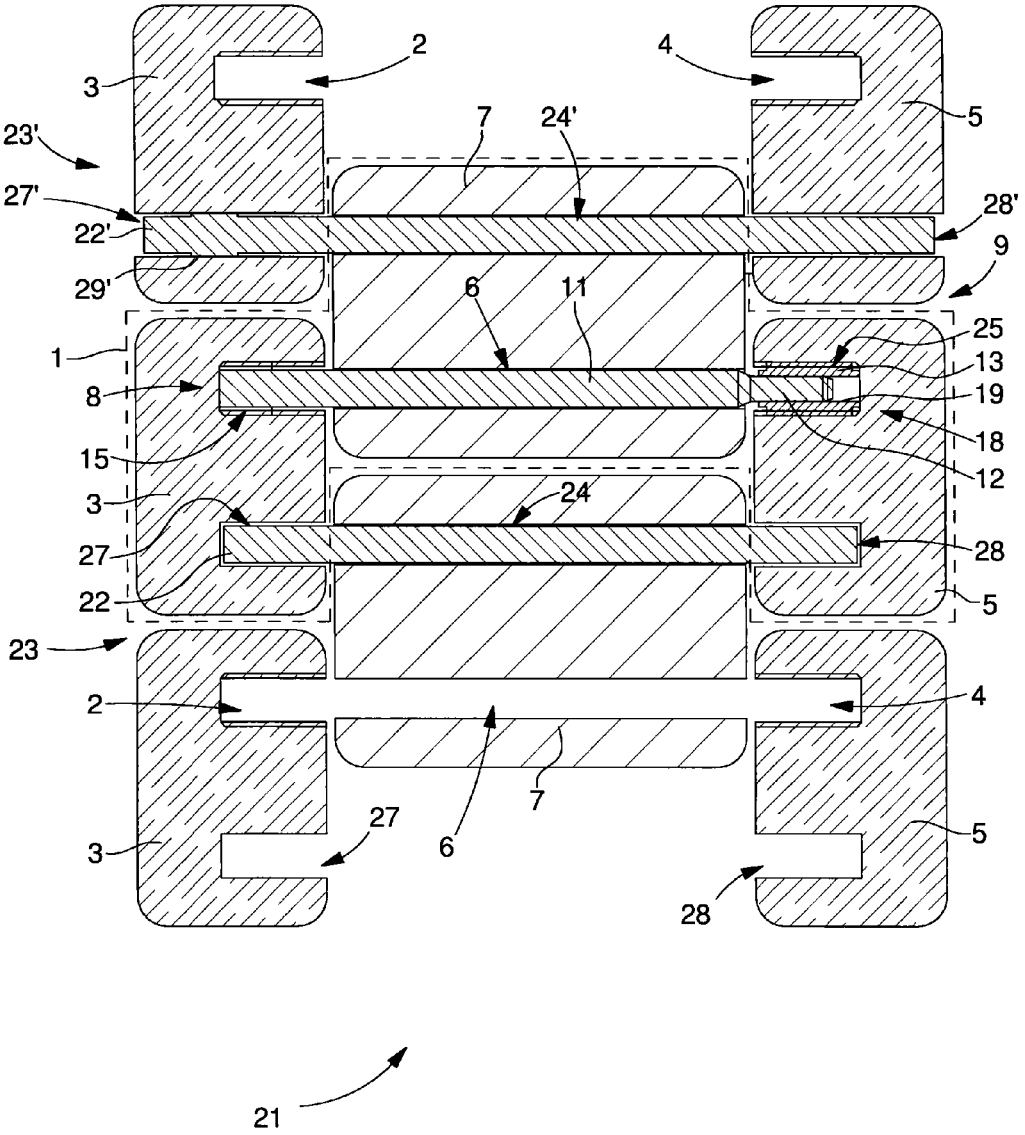
FIG. 1 is a cross-section of first type of assortment according to the invention.

Advantageously, in the example illustrated in FIG. 1, the invention relates to system 1 of assembling at least three parts 3, 5, 7 which may be wholly or partly formed of hard materials. Thus, the assembly system 1 according to the invention includes a first lateral part 3 and a second lateral part 5 which are substantially symmetrical relative to a central third part 7. It will be noted that parts 3, 5, 7 are preferably mounted staggered in relation to each other.

First and second parts 3, 5 each include a blind recess 2, 4, whereas the third part 7 includes a through hole 6. It will be noted in FIG. 1 that recesses 2, 4 and hole 6 are intended to be aligned in order to secure the first, second and third parts 3, 5, 7 to each other.

Advantageously according to the invention, assembly system 1 further includes a permanent securing device 9 for securing, in an inseparable manner, the first, second and third parts 3, 5, 7 to each other.

Figure 2:
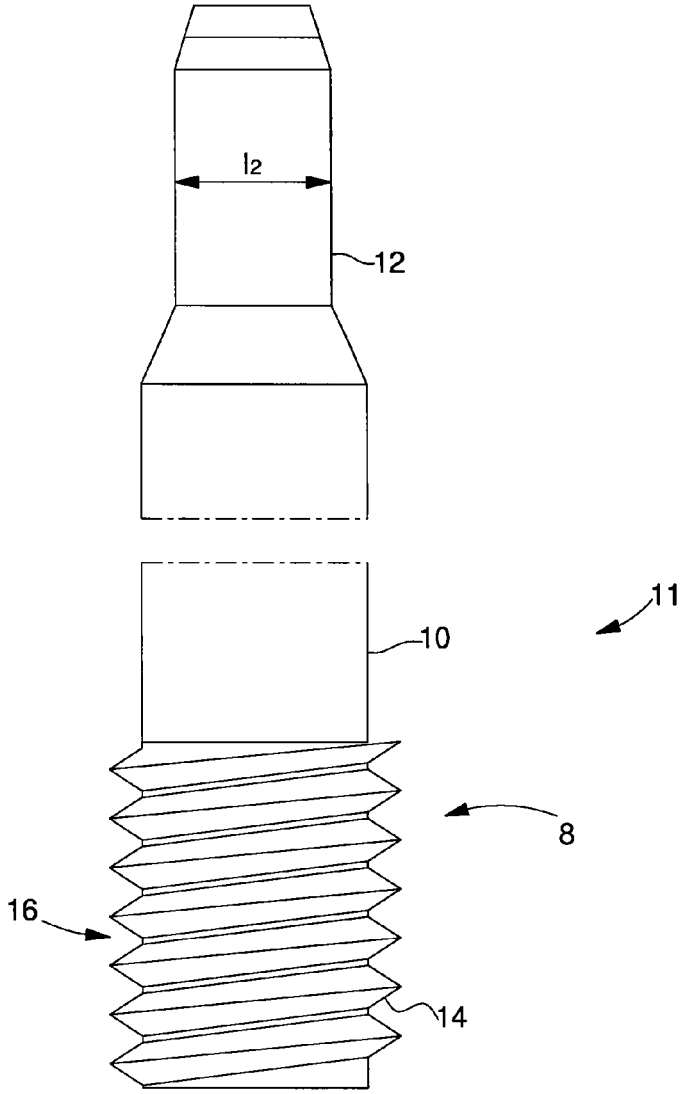
FIG. 2 is a partial view of a pin according to the invention.

Permanent securing device 9 preferably includes a pin 11 mounted in through hole 6 of central third part 7. Further, pin 11 includes, at a first end, a first means 8 of locking one 3 of first and second parts 3, 5 in blind recess 2. As seen more clearly in FIG. 2, pin 11 includes three single-piece portions 10, 12, 14. The main portion 10 of pin 11 has a cross-section of intermediate size relative to the other two portions and is intended to be received in through hole 6 of third part 7. Consequently, it is clear that, depending on the play allowed or the respective shape of through hole 6 and of portion 10, the first and second lateral parts 3, 5 will or will not be able to pivot relative to central third part 7.

By way of non-limiting example, through hole 6 may include a cross-section of non-circular shape matching that of portion 10 of pin 11 to prevent any relative pivoting of the first, second and third parts 3, 5, 7. Conversely, it is possible to envisage through hole 6 having a circular cross-section matching that of portion 10 of pin 11 to allow the pivoting of central third part 7 relative to lateral first and second parts 3, 5.

Figure 3:
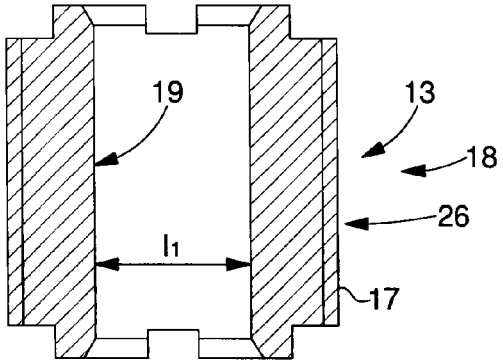
FIG. 3 is a cross-section of a socket according to the invention.

Portion 14 of pin 11 forms said first end where said first locking means 8 is located. In the example seen in FIGS. 1 to 3, first locking means 8 is formed by an internal thread 15 present in blind recess 2 of first part 3 and by an external thread 16 on the first end, namely portion 14 of pin 11. Finally, portion 12 of pin 11 has the smallest cross-section of pin 11 and is intended to be received in a socket 13 of permanent securing device 9.

Socket 13 includes, on the external 17 wall thereof a second means 18 of locking the other part 5 of first and second parts 3, 5 inside blind recess 4. In the example seen in FIGS. 1 to 3, second locking means 18 is formed by an internal thread 25 located in blind recess 4 of second part 5 and by an external thread 26 on external wall 17 of socket 13. Advantageously according to the invention, internal wall 19 of socket 13 is welded to the second end, namely portion 12, of pin 11 in order to secure the first, second and third parts 3, 5, 7 to each other with no plastic deformation of first and second parts 3, 5.

It will thus be understood that at least one portion of the first and second lateral parts 3, 5, but also of central third part 7, may thus be formed with hard materials, such as enamel and/or stone and/or ceramic, with no risk of breakage.

The method for mounting assembly system 1 is explained below. In a first step, parts 3, 5, 7 are manufactured with, for example, holes 2, 4, 6 which are formed immediately or machined afterwards. In a second step, socket 13 is mounted in hole 4 using second locking means 18. In a third step, pin 11 is mounted in hole 2 using first locking means 8. Of course, the second and third steps can be inverted.

In a fourth step, portion 10 and portion 12, namely the second end, of pin 11 projecting from lateral first part 3, are fitted into first through hole 6 of central third part 7. In this fourth step, socket 13 is also mounted in second lateral part 5 using second locking means 18.

In a fifth step, the second end, i.e. portion 12, of pin 11 projecting from central third part 7 is press-fitted against internal wall 19 of socket 13 mounted in second lateral part 5, i.e the maximum section $I_1$ of the internal wall is smaller than that $I_2$ of portion 12.

Finally, in a sixth and final step, the second end, namely portion 12, is welded to the internal wall 19 of socket 13. This welding is advantageously contact free and preferably via magnetic induction heating. Consequently, it will be understood that pin 11 and socket 13 are preferably formed by an electrically conductive material like a metal such as, for example, steel. Advantageously according to the invention, the press-fitting performed in the fifth step, facilitates the welding in the sixth step and avoids heating assembly system 1 for too long. At the end of the sixth and final step, parts 3, 5 and 7 are completely integral and assembly system 1 can only be disassembled by breaking or de-soldering the weld between socket 13 and pin 11.

Of course, assembly system 1 is not intended to be used alone. In fact, the final object of the invention is to form an assortment of several assembly systems connected to each other to form, for example, a bracelet or wristband, a decorative article or an item of jewelry.

Consequently, the invention also relates to an assortment 21, 51 including at least two assembly systems 1, 31 according to any of the variants explained above and below. Advantageously according to the invention, at least two assembly systems 1, 31 are connected to each other by a non-permanent securing device 23, 23', 53, 53'.

In a first type of assortment 21 seen in FIG. 1, the non-permanent securing device 23, 23' may include a pin 22, 22' removably mounted in a second through hole 24, 24' of one of said third parts 7 of one of said at least two assembly systems 1. Further, each end of pin 22, 22' is respectively mounted in second recesses 27, 28, 27', 28' of each of said first and second parts 3, 5 of the other of said at least two assembly systems 1.

Consequently, it will be understood that, as for first through hole 6, depending on the play allowed or the respective shape of the through hole 24, 24' of pin 22, 22', the first and second lateral parts 3, 5 of a first assembly system 1 will or will not be able to pivot relative to the central third part 7 of a second assembly system 1.

By way of non-limiting example, through hole 24, 24' may include a non circular cross-section matching that of pin 22, 22' to prevent any relative pivoting between the connected assembly systems 1. Conversely, it is possible to envisage through hole 24, 24' having a circular cross-section matching that of pin 22, 22' to allow pivoting between the connected assembly systems 1.

In a first variant of non-permanent securing device 23 seen in FIG. 1, the second recesses 27, 28 of each of said first and second parts 3, 5 of the other of said at least two assembly systems 1 are blind in order to render the assortment substantially inseparable. It is thus clear that, prior to the fifth step of mounting an assembly system 1, pin 22 is slid respectively into second through hole 24 of a central third part 7 of another assembly system 1, and into the second blind recess 27 of first lateral part 3 of assembly system 1.

Consequently, in the fifth step, not only is pin 11 press-fitted into socket 13, but pin 22 is locked in the second blind recesses 27, 28 and hole 24. Thus in the sixth and last step, after pin 11 has been welded to socket 13, pin 22 is no longer visible or accessible. At the end of the sixth and final step, two assembly systems 1 are completely integral and assortment 21 can only be disassembled by breaking the weld between socket 13 and pin 11.

In a second variant of non-permanent securing device 23' seen in FIG. 1, the two recesses 27', 28' of each of said first and second parts 3, 5 of the other of said at least two assembly systems 1 are through recesses in order to render the assortment detachable. It is thus clear that, prior to the fifth step of mounting an assembly system 1, pin 22' is slid respectively into second through hole 24' of a central third part 7 of another assembly system 1, and into the second through recess 27' of first lateral part 3 of assembly system 1.

Consequently, in the fifth step, pin 11 is press-fitted into socket 13 and pin 22' is locked in the second through recesses 27', 28' and hole 24'. Thus in the sixth and last step, after pin 11 has been welded to socket 13, pin 22' remains visible and accessible. At the end of the sixth and final step, two assembly systems 1 are completely integral and assortment 21 can be disassembled by removing pin 22' from second recesses 27', 28' and from hole 24' of one of the two assembly systems 1.

Advantageously according to the invention, the second variant of non-permanent securing device 23' also makes it possible for assembly systems 1 to be assembled one-by-one. Indeed, after two assembly systems 1 of three parts 3, 5, 7 have been secured using a permanent securing device 9, each assembly system 1 can be connected to the other by mounting a pin 22' in the second recesses 27', 28' and hole 24'.

Preferably, pin 22' of the second variant of non-permanent securing device 23' is held in the second recesses 27', 28' and hole 24' using at least one protuberance 29' intended to slide with low friction into at least one of second recesses 27', 28' and hole 24'.

Figure 4:
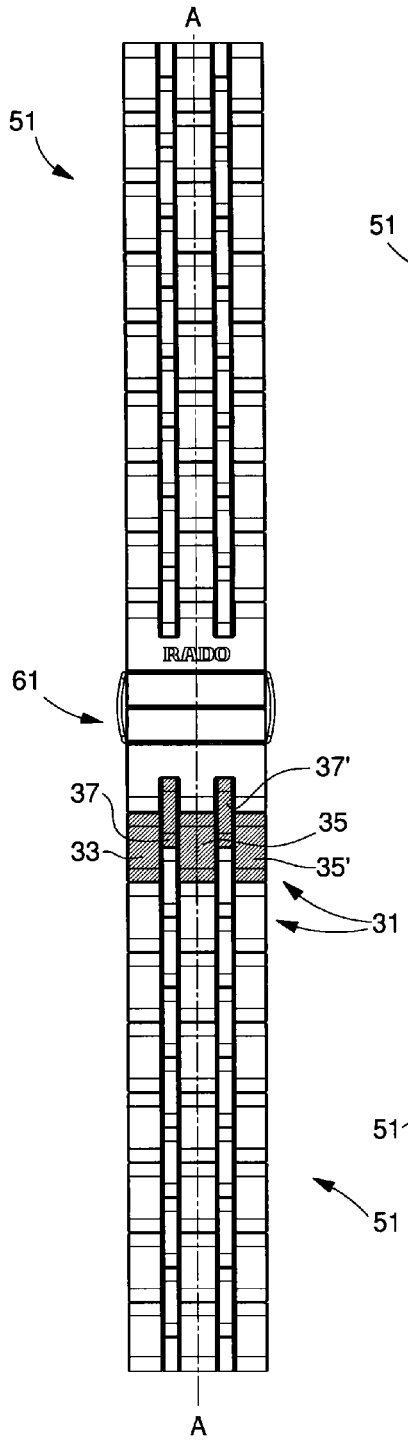
FIG. 4 is a top view of second type of assortment according to the invention.
Figure 5:
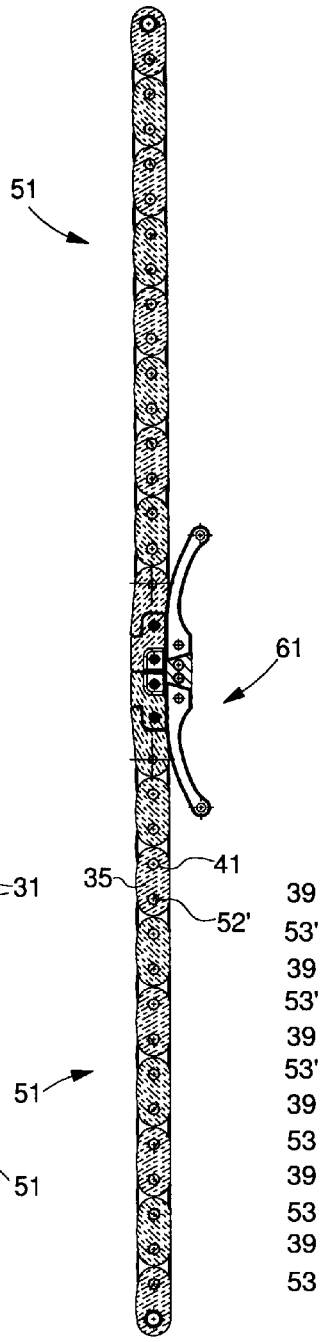
FIG. 5 is a cross-section along axis A-A of FIG. 4.
Figure 6:
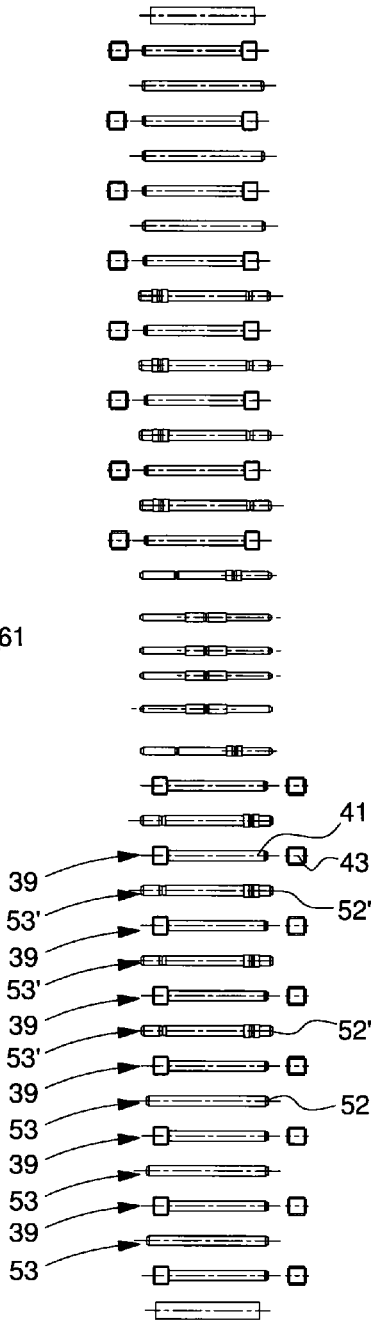
FIG. 6 is a view of the securing devices used for the assortment of FIG. 4.

A second type of assortment 51 is shown in FIGS. 4 to 6. These FIGS. 4 to 6 show two assortments 51 connected to each other by a clasp 61 to form a bracelet or wristband intended to be mounted in the middle part of a timepiece case. Each assembly system 31 of assortments 51 differs from the first 1 in that it is formed of five parts and no longer of three. Indeed, in addition to the three parts 33, 37', 37 comparable to those 3, 5, 7 of the first type of assembly system 1, the second type of assembly system 31 includes a separator row, i.e. an additional central second part 37' and intermediate part 35. However, it will be understood that the manufacture and operation explained above do not differ for this second type of assortment 51.

Thus, as seen in FIG. 6, in a similar manner to the above explanation, assortments 51 include permanent securing devices 39 (a pin 41 secured by welding to a socket 43) alternating with removable non-permanent securing devices 53' (pin 52') and/or inseparable non-permanent securing devices 53 (pin 52). It will be noted, however, that pin 43 no longer includes a second end of smaller cross-section than the main portion. It is thus clear that the narrowing of the cross-section of portion 12 relative to portion 10 of pin 11 is merely optional in the first type of assortment 21. This narrowing of portion 12 is thus only guided by any excessively restricted dimensions of lateral parts 3, 5, 33, 35' which require the dimensions of securing device 9 to be reduced.

Of course, this invention is not limited to the illustrated example but is capable of various variants and alterations that will appear to those skilled in the art. In particular, the first and second locking means 8, 18 may be of a different nature than the internal thread 15, 25—external thread 16, 26 type devices and/or be of a different nature from each other. By way of non-limiting example, the first and/or second locking means could also be formed by bayonet-type devices between said at least one blind recess of the first and second parts, the pin and the socket providing a durable, low stress securing for the first and second parts, like the internal-external thread devices.

Further, the number, dimensions and geometry of the parts for each assembly system may be different without losing the advantages of the invention.

As explained above, said at least one third part 7, 35, 37', 37 may thus include several parts 35, 37', 37 to form a through hole 6. It is thus clear that said at least one third part may include between 1 and several tens of parts between each lateral part 3, 5, 33, 35'. Alternatively, said at least one third part may only include one piece of more complex geometry such as, for example, a single-piece part forming parts 37, 35 and 37'.

What is claimed is:

1. An assembly system comprising:

first and second parts each including a blind recess; and at least one third part including a through hole, wherein the assembly system further includes a permanent securing device including a pin mounted in the through hole of the at least one third part, the pin including, at a first end, a first mechanism to lock the pin to one of the first and second parts in the corresponding blind recess, and a socket whose external wall includes a second mechanism to lock the socket to the other of the first and second parts in the corresponding blind recess, and an internal wall of the socket is welded to a second end of the pin in order to join the first part, the second part, and the at least one third part to each other with no plastic deformation of the first and second parts.

2. The assembly system according to claim 1, wherein the through hole includes a cross-section of matching non-circular shape to a cross-section of the pin, to prevent any relative pivoting of the first, second and at least one third part.

3. The assembly system according to claim 1, wherein the through hole includes a cross-section of matching circular shape to a cross-section of the pin to allow the pivoting of the at least one third part relative to the first and second parts.

4. The assembly system according to claim 1, wherein the first mechanism is formed by a threaded connection or a bayonet device.

5. The assembly system according to claim 1, wherein the second mechanism is formed by an internal thread-external thread type device or a bayonet type device.

6. The assembly system according to claim 1, wherein the at least one third part includes several parts forming the through hole.

7. The assembly system according to claim 1, wherein at least one portion of the first and second parts is formed with at least one of enamel, stone, and ceramic.

8. An assortment wherein the assortment includes at least two assembly systems according to claim 1, which are connected to each other by a non-permanent securing device, the non-permanent securing device including a second pin removably mounted in a second through hole in one of a plurality of third parts of one of the at least two assembly systems and in second recesses in each of the first and second parts of the other of the at least two assembly systems.

9. The assortment according to claim 8, wherein at least one of the second recesses of each of the first and second parts of the other of the at least two assembly systems are blind in order to render the assortment substantially inseparable.

10. The assortment according to claim 8, wherein at least one of the second recesses of each of the first and second parts of the other of the at least two assembly systems are through recesses in order to render the assortment detachable.

11. The assortment according to claim 8, wherein the assortment includes at least five assembly systems connected to form at least one of a bracelet, wristband, a decorative article, and a jewelry item.

* * * * *